United States Patent [19]

Luy

[11] 4,359,710

[45] Nov. 16, 1982

[54] ANNULAR RESISTOR WITH ZIG-ZAG LAYER PATTERN FOR RESISTANCE ELEMENTS

[75] Inventor: William R. Luy, Colgate, Wis.

[73] Assignee: Eaton Corporation, Cleveland, Ohio

[21] Appl. No.: 120,441

[22] Filed: Feb. 11, 1980

[51] Int. Cl.[3] ..... H01C 1/08

[52] U.S. Cl. ..... 338/51; 303/20; 338/280; 338/316; 338/319

[58] Field of Search ..... 338/51, 279, 280, 281, 338/283, 284, 287, 315, 316; 219/374; 303/20

[56] References Cited

U.S. PATENT DOCUMENTS

| | | | |
|---|---|---|---|
| 2,875,310 | 2/1959 | Schoch | 338/284 |
| 3,237,142 | 2/1966 | Nuss | 338/280 |
| 3,697,923 | 10/1972 | Griffes | 338/280 |
| 4,051,452 | 9/1977 | Luy | 338/51 |
| 4,146,868 | 3/1979 | Kirilloff et al. | 338/280 |

*Primary Examiner*—C. L. Albritton

*Attorney, Agent, or Firm*—C. H. Grace; F. M. Sajovec

[57] ABSTRACT

An improved annular resistor, suitable for use in a diesel electric locomotive dynamic braking system and similar applications comprising an assembly of similar arcuate segments. Each resistor segment has a supporting frame (11, 13) and a continuous resistance ribbon (53, 55, 57, 59) having a plurality of reflexed radial extensions between the two parts of the frame, electrically isolated from the frame. To allow expansion and contraction of the ribbon, U-shaped folds of the ribbon are mounted on pin supports (51). The pin supports are mounted to insulator blocks (27, 29, 37, 39), and are set so as to position the ribbons in a zig-zag or chevron pattern, in order to enhance cooling and improve the flow of air over the ribbon surfaces. Three terminals (67, 73, 75) are provided on each segment to allow part of the resistance of each segment to be removed from the circuit.

14 Claims, 8 Drawing Figures

Fig. 1
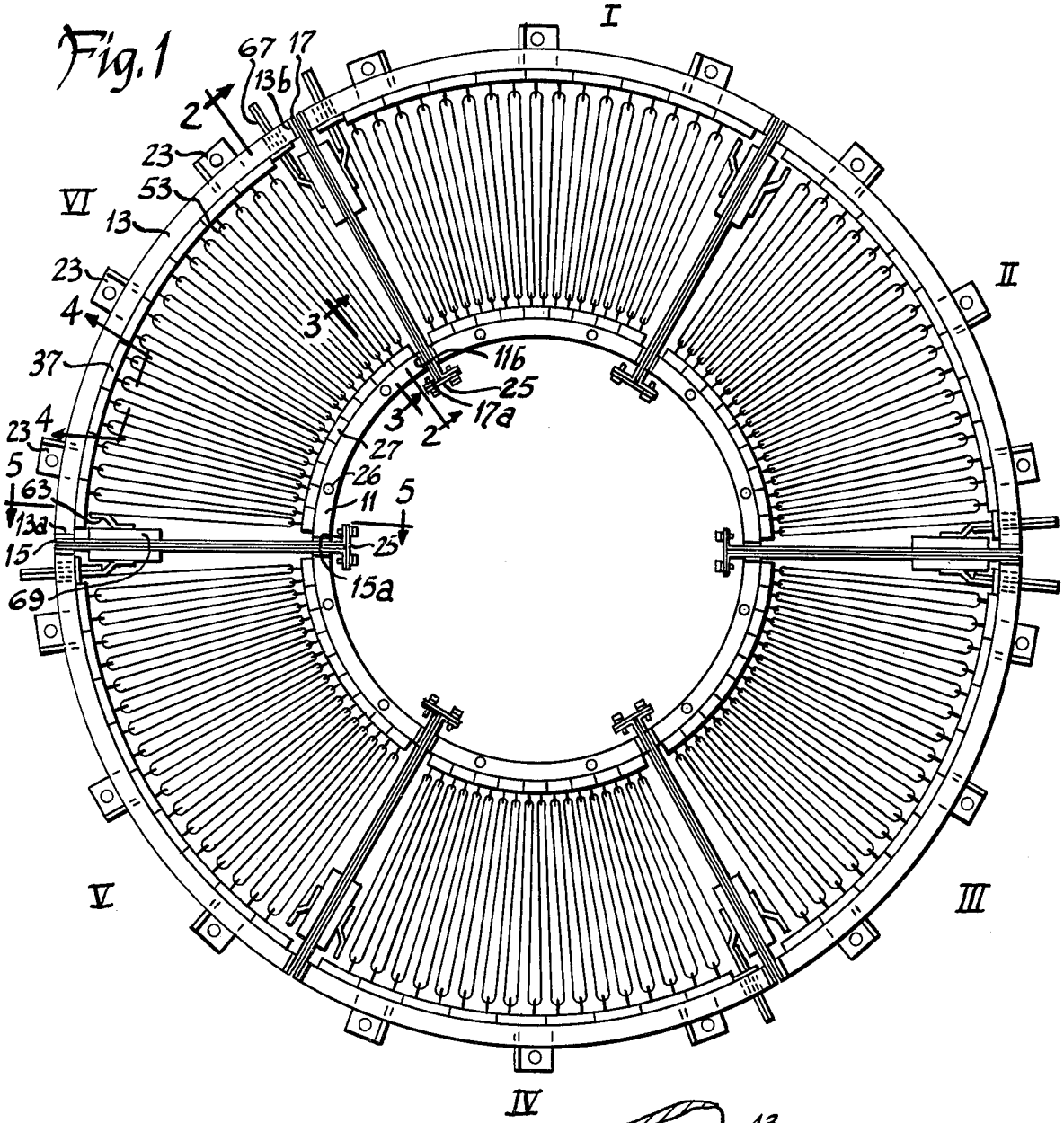
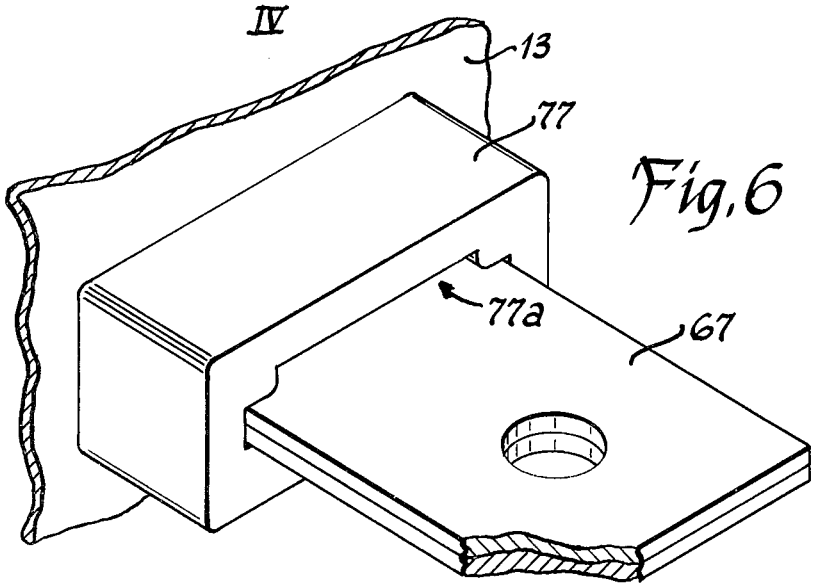
Fig. 6

Fig. 3
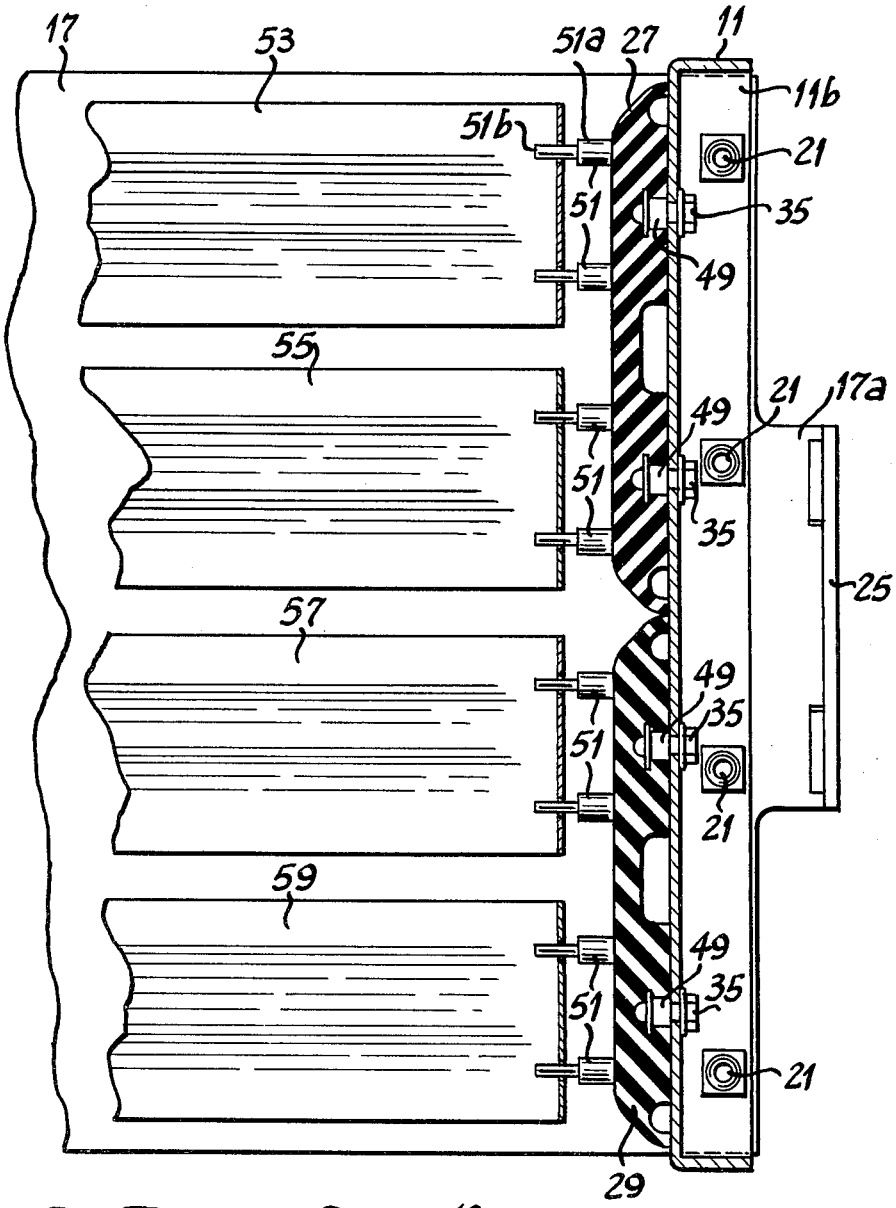
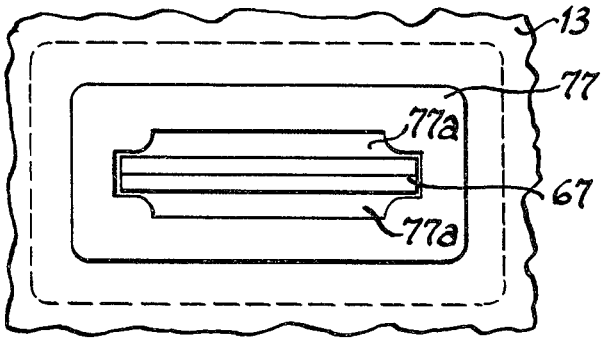
Fig. 7

ANNULAR RESISTOR WITH ZIG-ZAG LAYER PATTERN FOR RESISTANCE ELEMENTS

BACKGROUND OF THE INVENTION

Annular resistors for application in diesel electric locomotive dynamic braking systems have been known heretofore. For example, W. R. Luy, U.S. Pat. No. 4,051,452, issued Sept. 22, 1977, and assigned to the assignee of this invention, discloses an annular resistor of that type. While that resistor could be useful for its intended purposes, this invention relates to improvements thereover.

SUMMARY OF THE INVENTION

One object of the invention is to provide an improved annular resistor.

Another object of this invention is to provide a resistor of the aforementioned character which is divided into identical replaceable segments.

Still another object of the invention is to provide a resistor of the aforementioned character requiring mounting support only at the outer frame, with a tie plate joining the end frames of adjacent resistors together at the inner frame area and providing mechanical support.

A more specific object of the invention is to provide a resistor of the above type wherein the ribbons of resistive material are not aligned or interlaced but rather "skewed", using a zig-zag pattern, to direct additional air to impact against the ribbons, and to increase air turbulence at the ribbon surfaces, and thus improve cooling of the ribbons in operation.

Another specific object of this invention is to provide a resistor of the above type which employs improved terminal bushing insulators which allow air to flow across the terminals in proportion to the air pressure differential between the ribbon area and the area external to the outer frame, thus cooling the terminals.

DESCRIPTION OF THE DRAWINGS

FIG. 1 is a top view of a resistor assembly constructed in accordance with the invention.

FIG. 3 is a fragmentary cross-sectional view taken along line 3—3 of FIG. 1.

FIG. 6 is a fragmentary isometric view of a terminal and its insulator bushing.

FIG. 7 is a front view of a terminal in its insulator bushing.

DESCRIPTION OF THE PREFERRED EMBODIMENT

Figure 2:
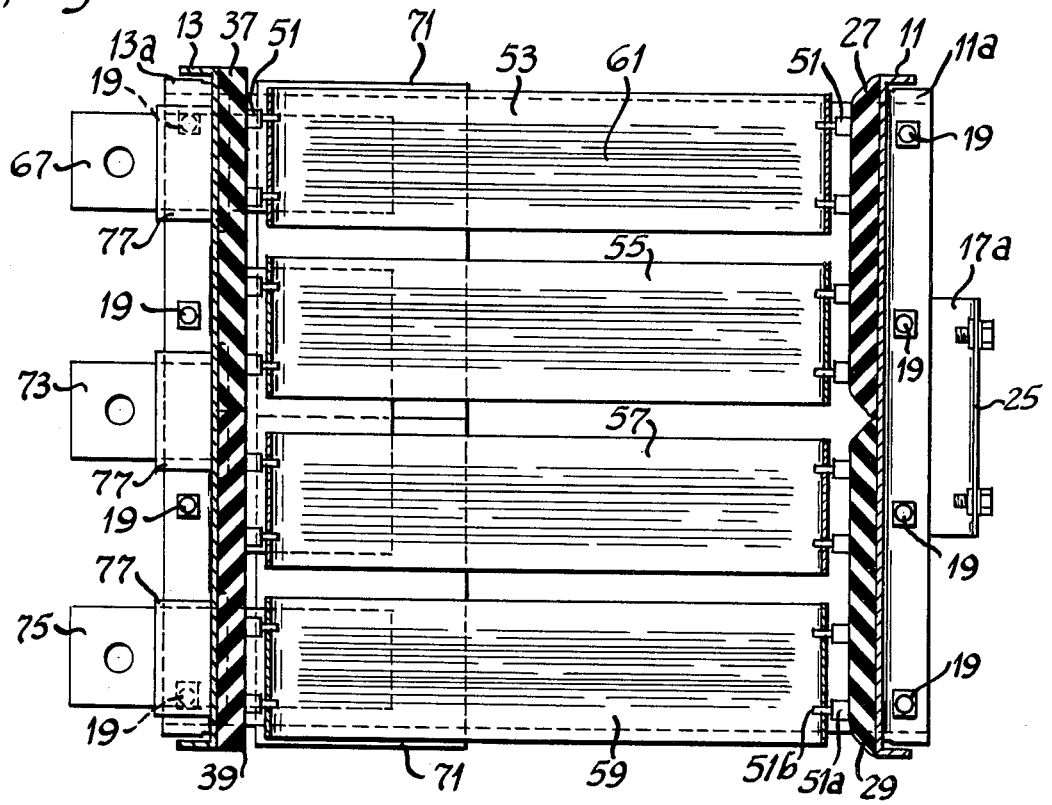
FIG. 2 is a cross-sectional view taken along line 2—2 of FIG. 1.

The improved resistor assembly comprises six individually replaceable segments, I–VI. The segments differ from each other only in that three have terminals on the left side while the other three have terminals on the right. Segment I is further distinguished by the fact that it is a fan tap resistor, that is, power is tapped from it to energize the fan motor, though it is identical in physical appearance to the other segments. For this reason only segment VI will be described in detail.

With reference in more detail to FIG. 1, a supporting frame is provided having an inner arcuate member 11 and a spaced apart outer arcuate member 13 which extends around a common center. These two frame members are securely attached to end frame members 15 and 17 by means of screws 19, FIGS. 2 and 5, extending through circular apertures (not shown) in the inner and outer portions of said end members, through circular apertures 21 in flange portions **13*a* and 13*b* of the outer member and 11*a* and 11*b* of the inner member and into weld nuts on said flange members as shown in FIGS. 1, 2, 3 and 5. As seen in FIG. 1, mounting brackets 23 are provided along the outer periphery of the frame and attached thereto in any suitable manner, such as by welding. These brackets are so positioned as to enable mounting of the resistor directly above a fan. Support on the inner periphery in the improved resistor is provided by a tie plate 25 which is bolted to right angle flange portions 15*a* and 17*a* at the inner ends of the end frame members 15 and 17, thus eliminating the need for any exterior support at the inner periphery. Circular apertures 26 are provided in inner frame member 11** for attachment of a cover (not shown) on the resistor assembly.

Two rows of electrical insulator blocks 27 and 29, are positioned side by side along inner member 11, each block secured thereto by means of bolts 35, as shown in FIGS. 1–3 and 4. Similarly, there are also provided insulator blocks 37 and 39, along the outer member 13, as shown in FIGS. 1, 2 and 5.

Figure 4:
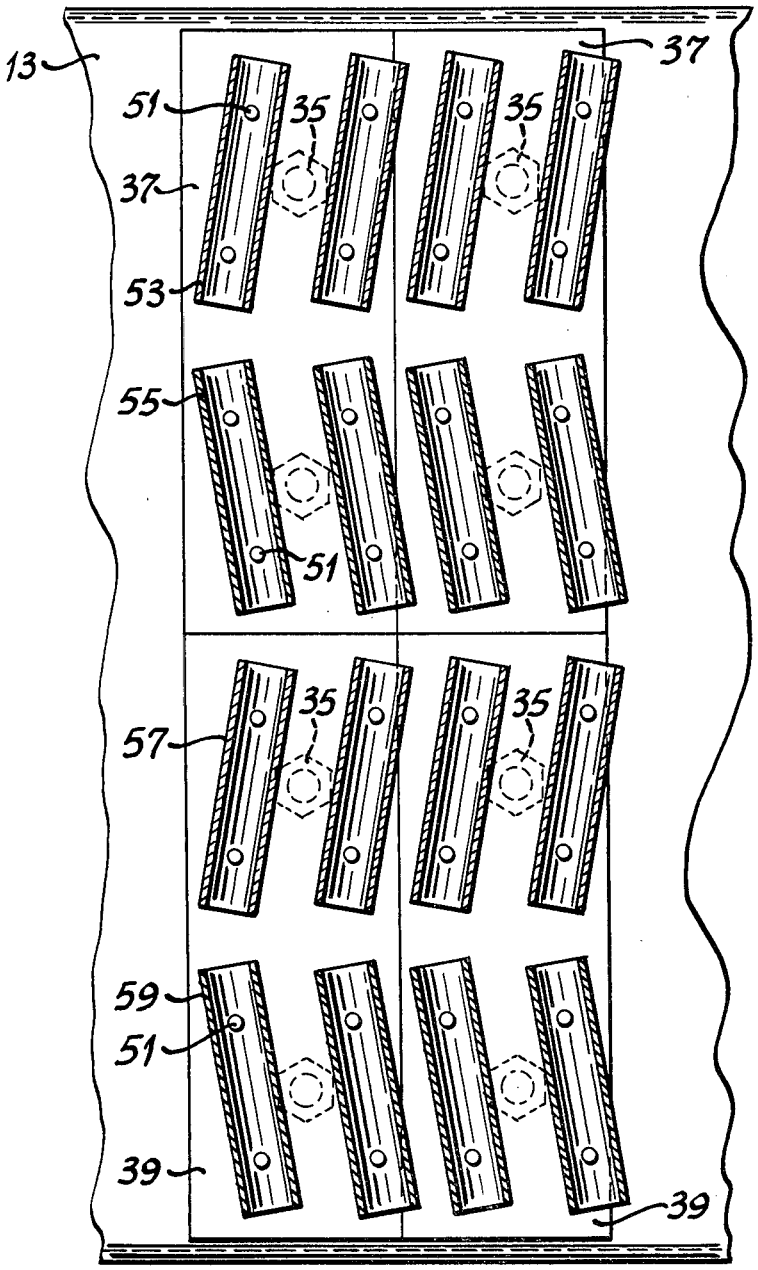
FIG. 4 is a fragmentary view taken along line 4—4 of FIG. 1.
Figure 8:
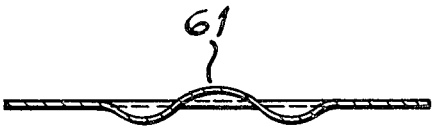
FIG. 8 is a cross-sectional view of a resistor ribbon showing convolutions.

FIG. 4 shows several insulator blocks mounted to the outer support member 13. Insulator block 37 is mounted in the upper row of blocks. Circular apertures are formed in member 13 in a vertical line, and insulator block 37 is secured to the frame by means of bolt 35 extending through one of said apertures and into threaded engagement with an insert 49 molded in said insulator block or by other suitable means. See FIG. 3. Insulator block 39 is similarly mounted below block 37. Member 11 has corresponding apertures and insulator blocks 27 and 29 are similarly mounted thereon. Blocks 27 and 29 may have beveled edges as shown in FIGS. 2, 3 and 5.

Figure 5:
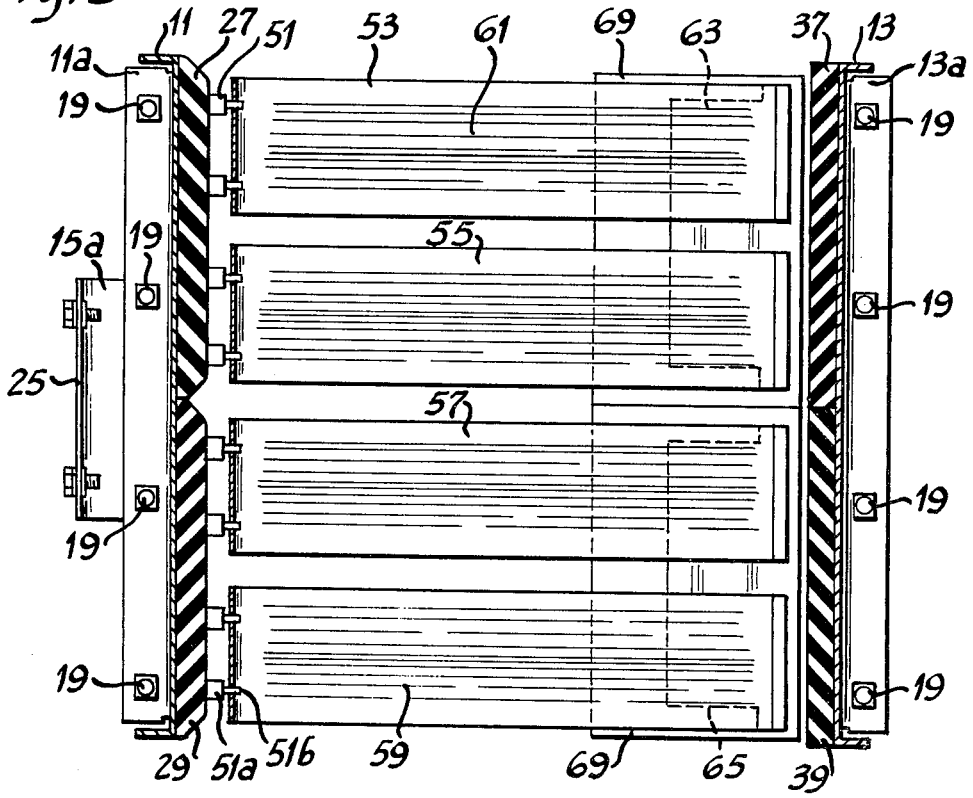
FIG. 5 is a cross-sectional view taken along line 5—5 of FIG. 1.

Molded into each insulator block are eight supporting pins 51 each having a shoulder portion **51*a* and a ribbon mounting portion 51*b*, as shown in FIGS. 2, 3 and 5. Extending between the inner and outer frame members of segment VI are four continuous reflexed ribbons, 53, 55, 57 and 59, each forming a plurality of radial extensions joined by U-shaped folds, as shown in FIGS. 1 and 3. Each of the U-shaped folds has two apertures for loosely receiving the ribbon mounting portion 51*b* of the corresponding supporting pin 51. As illustrated in FIG. 4, the two supporting pins for each U-shaped bend of each ribbon form a line that is not vertical but rather is canted or skewed from the vertical. Ribbons 53 and 57 are skewed at that angle in one direction whereas ribbons 55 and 59** are skewed at the same angle but in the opposite direction. This design results in a zig-zag or chevron pattern of travel for the air currents as they pass through the resistor, thus increasing the amount of air impacting against the ribbon surfaces, and greatly improving the cooling and power dissipation of the resistor. Consequently, the temperature of the ribbon and of the insulating blocks is reduced.

In use, the ribbon is allowed to thermally expand along ribbon mounting portions 51*b* of the pin 51. The shoulder portion 51*a*, insures adequate spacing between the ribbon and the insulator blocks. As shown in FIGS. 2, 3, 5 and 8, the ribbon is formed with convolutions 61 along each radial extension to increase its structural stiffness and to agitate the airflow around the ribbon to provide further convectional cooling.

The four ribbons in each segment are electrically interconnected in series by means of connector straps 63 and 65, FIGS. 1 and 5, each having its ends welded to two of said ribbons and its middle attached to one of the insulators 69. Insulators 69 are in turn attached to end member 15 in a suitable manner. Terminals 67, 73, and 75 shown in FIG. 2 are provided for connection to a traction motor acting as a generator in a dynamic braking system. The purpose of the three terminals is to provide the capability of removing part of each resistor from the circuit, thus giving greater braking force at low speeds. Each terminal is secured to one or both of the insulators 71, which are in turn attached to end frame member 17. As shown in FIGS. 1 and 2, each terminal extends through the outer frame member 13, being electrically isolated therefrom by an insulative bushing 77, illustrated in FIGS. 6 and 7.

Bushing 77 is designed with air gaps 77*a* on two sides of the terminal to allow air to flow across the terminal proportional to the air pressure differential between the ribbon area and the external hatch area, thus improving convectional cooling of the terminals. Ribbon 53 is electrically connected to terminal 67, ribbons 55 and 57 to terminal 73, and ribbon 59 to terminal 75 in any suitable manner such as by welding. Thus the current path is as follows: terminal 75 to ribbon 59 to connector strap 65 to ribbon 57 to terminal 73 to ribbon 55 to connector strap 63 to ribbon 53 to terminal 67.

What is claimed is:

1. A resistor comprising in combination:

a supporting frame having inner and outer arcuate portions and portions holding them in spaced apart concentric relationship;

insulating means secured to the arcuate opposing faces of said inner and outer spaced frame portions;

a plurality of layers of reflexed resistance ribbons, each of said ribbons having segments arranged in a radial relation between the inner and outer portions of said supporting frame, said segments attached to each other at connections in proximity to said insulating means, said layers of resistance ribbon being mounted such that the ribbon surfaces of the different layers are skewed, in a zig-zag pattern;

support means between said insulating means and said connections between said radial segments of said ribbons for providing individual support for each of said connections and holding said ribbons in the zig-zag pattern within the space defined by opposing faces of said insulating means; and terminal means connected to said ribbons for connecting the latter to a source of electric current.

2. A resistor as recited in claim 1 wherein said connections between said radial segments of said ribbons comprise U-shaped bends such that said bends and said radial segments form a continuous reflexed ribbon between opposing faces of said insulating means.

3. A resistor assembly comprising in combination:

a plurality of individually replaceable resistance units secured together in an annular configuration, each of said units being independently connectable to a source of electric current, and each of said units comprising:

a supporting frame having inner and outer arcuate portions and portions holding them in spaced apart concentric relationship;

insulating means secured to the arcuate opposing faces of said inner and outer spaced frame portions;

a plurality of layers of reflexed resistance ribbons, each of said ribbons having inner and outer U-shaped bends in proximity to said insulating means and segments connecting and arranged in a radial relation between said inner and outer bends, said layers of resistance ribbons being mounted on said insulating means such that the ribbon surfaces of the different layers are skewed, in a zig-zag pattern;

support means between said insulating means and said U-shaped bends for providing individual support for each of said bends and holding said ribbons in the zig-zag pattern within the space defined by opposing faces of said insulating means; and terminal means connected to said ribbons for connecting the latter to a source of electric current.

4. A resistor assembly as recited in claim 3 wherein said resistance units are secured together by means of tie plates, each of which plates is fastened to two adjoining units.

5. A resistor as recited in claim 2 wherein said insulating means comprises a plurality of rows of insulator blocks, with two layers of resistance ribbon for each row of insulator blocks.

6. A resistor as recited in claim 2 wherein said support means is secured to said insulating means, providing support to said U-shaped bends.

7. In a resistor having a plurality of like, arcuate inner and outer spaced frame members connected at their ends by a pair of straight members to form a segment of an annulus, insulator blocks secured to the opposing faces of said inner and outer spaced frame members, a plurality of layers of reflexed resistance ribbons, each of said ribbons having inner and outer U-shaped bends in proximity to said insulators and segments connecting and arranged in a radial relation between said inner and outer bends, support means secured to said insulators and providing individual support for each of said bends, and terminal means connected to said ribbon means for connecting the latter to a source of electric current, the improvement wherein:

said layers of resistance ribbons are mounted on said insulating means such that the individual ribbon surfaces are skewed, in a zig-zag pattern.

8. The improvement defined in claim 7 wherein said terminal means are cooled by means of an insulator bushing surrounding said terminal means, which insulator bushing has air gaps around said terminal means, allowing air to pass over the latter.

9. A resistor as recited in claim 5 or claim 8 wherein said support means comprises a plurality of pins anchored to said insulator blocks, and wherein each of said U-shaped bends has at least one aperture therein for loosely receiving a corresponding pin, each of said pins having a shoulder portion wider than said aperture to keep said U-shaped bends spaced from said insulator blocks.

10. A resistor as recited in claim 9 wherein said terminal means comprise at least three terminals, arranged such that part of said resistor may be disconnected from the circuit.

11. A resistor assembly as recited in claim 3 wherein said resistance units are secured together along the inner portions of said supporting frames.

12. A resistor assembly as recited in claim 3 wherein said portions holding said inner and outer arcuate frame portions in spaced apart relationship comprise end members secured to the respective ends of said arcuate portions, said end members having portions extending inwardly beyond said inner arcuate portions, and wherein adjacent inwardly extending portions of said end members of adjoining resistance units are secured together by means of tie plates.

13. A resistor assembly as recited in claim 4 wherein said tie plates fasten adjoining resistance units together at the inner frame portions.

14. A resistor assembly as recited in claim 3 or claim 7 wherein segments of said ribbon between the inner and outer U-shaped bends have convolutions formed therein.

* * * * *